US006032914A

United States Patent [19]

Bastida

[11] Patent Number: 6,032,914

[45] Date of Patent: Mar. 7, 2000

[54] ADJUSTABLE LEG

[75] Inventor: Horacio Bastida, S. Nicolas De Los Garza, Mexico

[73] Assignee: Southland Supply Company, Inc., Galveston, Tex.

[21] Appl. No.: 08/891,713

[22] Filed: Jul. 11, 1997

[51] Int. Cl.[7] ..... A47F 5/00

[52] U.S. Cl. ..... 248/354.1; 248/188.5; 403/104

[58] Field of Search ..... 248/354.1, 188.1–188.4, 248/188.5, 354.3, 354.5, 176.1, 333, 351, 592, 584, 593; 403/104

[56] References Cited

U.S. PATENT DOCUMENTS

| | | | |
|---|---|---|---|
| 1,303,416 | 5/1919 | Tidyman | 182/155 |
| 1,542,335 | 6/1925 | Cardarelli | 248/81 |
| 2,714,498 | 8/1955 | Wuthrich | 248/354.3 |
| 3,523,702 | 8/1970 | Unti et al. | 403/107 |
| 3,527,436 | 9/1970 | Stone et al. | 248/188.4 |
| 3,704,850 | 12/1972 | Hendrickson et al. | 248/188.5 |
| 3,734,441 | 5/1973 | Lux | 248/354 |
| 3,780,974 | 12/1973 | Takahashi | 248/411 |
| 4,185,936 | 1/1980 | Takahashi | 403/104 |
| 4,596,484 | 6/1986 | Nakatani | 403/104 |
| 4,695,028 | 9/1987 | Hunter | 248/354.1 |
| 4,761,092 | 8/1988 | Nakatani | 403/104 |
| 4,928,916 | 5/1990 | Molloy | 248/354.1 |
| 4,932,622 | 6/1990 | Hayakawa | 248/188.5 |
| 5,470,038 | 11/1995 | Clark | 248/156 |

*Primary Examiner*—Derek J. Berger
*Assistant Examiner*—Tan Le
*Attorney, Agent, or Firm*—Browning Bushman

[57] ABSTRACT

An adjustable leg for use with benches, stilts, and the like, the leg including a first strut having a first strut end wall defining an outer surface, the first strut end wall having a first aperture therein, a second elongate strut, the second elongate strut having a second strut end wall and being telescopically received in the first strut, the first strut end wall being adjacent the second strut end wall, the second strut end wall having a plurality of second apertures, a lever journalled for rotational movement about an axis outward of the outer surface on the first strut end wall, the lever having a first portion on one side of the axis of rotation and a second portion on the other side of the axis of rotation, a resilient biaser to urge the first portion of the lever away from the first strut end wall and a latching dog carried by the second portion of the lever end wall and being in register with the first aperture, the resilient biaser urging the latching dog into the first aperture whereby when the first aperture is in register with one of the second apertures, the dog extends through the first and second apertures to thereby prevent any substantial telescopic movement between the first and second struts.

11 Claims, 3 Drawing Sheets

FIG. 1
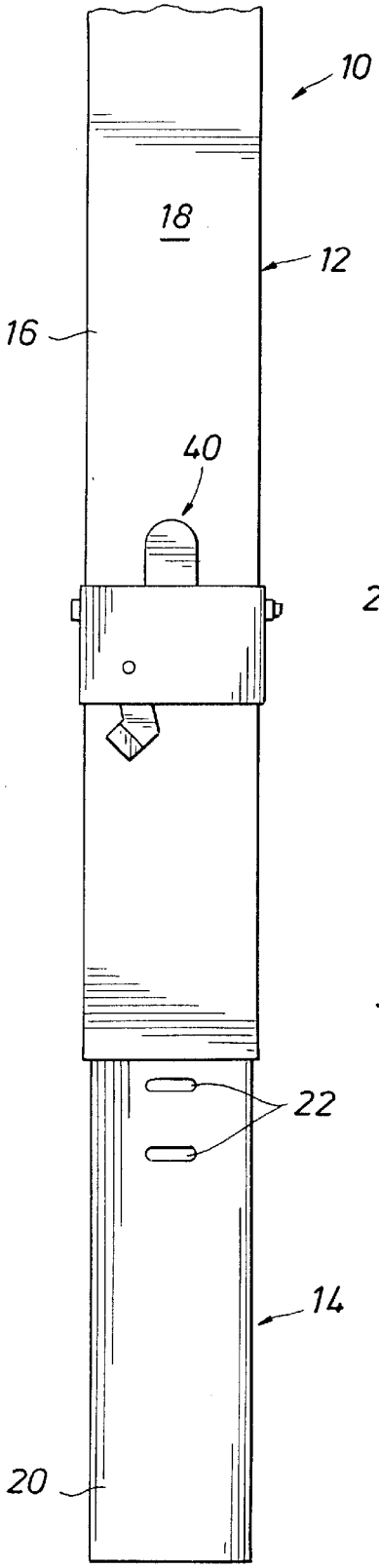
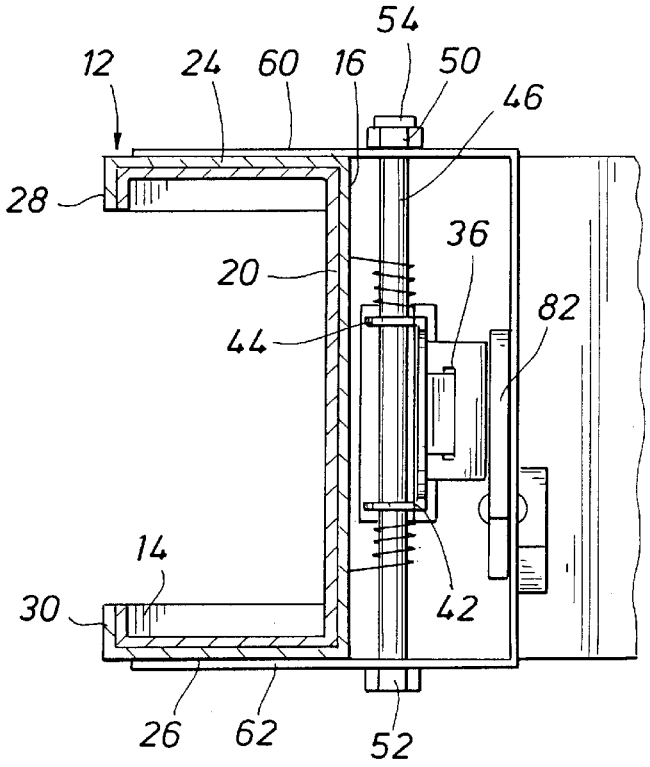
FIG. 6

ADJUSTABLE LEG

BACKGROUND OF THE INVENTION

1. Field of the Invention

The present invention relates to an adjustable leg. More particularly, the present invention relates to an adjustable leg for use with a bench, stilt, or the like used by workmen engaged in sheetrocking, plastering, painting, and other building construction procedures.

2. Description of the Prior Art

In the building construction field, and primarily in the interior finishing of both residential and commercial buildings, it is common for workers such as painters, wallboard installers, plasterers, etc., to use adjustable stilts or benches that have legs that can be vertically adjusted to alter their height and allow various tasks to be performed at higher elevations. By way of example, adjustable stilts are commonly used during the installation of wallboards. Typically, the stilts include a pair of rigidly connected vertically adjustable legs defined by upper and lower struts, the bottom of each lower strut being attached to a rubber footpad, the upper ends of the upper struts being strapped to the workman's foot and leg.

Adjustable benches are also used extensively, not only in wallboard installation, but in plastering, painting, and other building construction and/or finishing procedures. The adjustable benches typically have a planar work platform for workers to stand or walk on and a supporting framework comprised of four, independently adjustable legs that allow the bench work platform to be kept in a generally horizontal disposition while the legs are resting on several different elevations. For example, when working on a wall or walls defining a stairway well, it will be appreciated that to maintain a horizontal work platform upon which workers can stand, one end of the bench will have the legs adjusted to one height, and the opposite end of the bench will have the legs adjusted to a second longer or shorter height, depending on the relative disposition of the bench on the stairway. In any event, the ability to independently adjust the four legs of the bench to various heights greatly simplifies the problem of maintaining a level, substantially horizontal work platform in an environment where the floor and other supporting surfaces for the legs are at various levels.

As disclosed in U.S. Pat. No. 4,569,516, it is desirable that the adjustable legs used on stilts, benches, and the like have a quick-release mechanism that allows the height to be quickly and securely adjusted. Accordingly, there is disclosed in U.S. Pat. No. 4,569,516 a quick-action lock that employs a single, integral curve spring that carries a pair of adjustment pegs and firmly maintains the pegs within registering adjustment holes in the upper and lower struts. The adjustable legs disclosed in U.S. Pat. No. 4,569,516 suffer from the disadvantage that the quick-release lock is not readily accessible to a worker and requires substantial squeezing force between the thumb and forefinger of a user in order to disengage the lock and adjust the leg height.

SUMMARY OF THE INVENTION

It is therefore an object of the present invention to provide an adjustable leg for stilts, benches, and the like that is easy to manipulate and readily accessible.

Another object of the present invention is to provide a vertically adjustable leg for use with stilts, benches, and the like that can be easily manipulated without the use of high manual force.

Still a further object of the present invention is to provide an adjustable leg having a quick release latching or locking mechanism that includes a safety latch to minimize accidental disengagement of the lock that keeps the two struts of the leg from moving relative to one another.

The above and other objects of the present invention will become apparent from the drawings, the description given herein, and the appended claims.

In accordance with the present invention, there is provided an adjustable leg for use with benches, stilts, and the like comprising a first elongate strut that has a first strut end wall defining an outer surface, the first strut end wall having a first aperture therein. A second elongate strut having a second strut end wall is telescopically received in the first strut, the first strut end wall being adjacent the second strut end wall, the second strut end wall having a plurality of second apertures therein. A lever is journalled for rotational movement about an axis outwardly of the outer surface of the first strut end wall, the lever having a first portion on one side of the axis of rotation and a second portion on the other side of the axis of rotation. A resilient biaser, e.g., a spring, is positioned to urge the first portion of the lever away from the first strut end wall. A latching dog carried by the second portion of the lever is in register with the first aperture. The resilient biaser urges the latching dog into the first aperture such that when the first aperture is in register with one of the second apertures, the dog extends through both the first and second apertures to effectively lock the first and second struts together and prevent any substantial telescopic movement thereof.

BRIEF DESCRIPTION OF THE DRAWINGS

The invention can be best understood with reference to the drawings wherein:

FIG. 1 is a front elevational view of a portion of the adjustable leg of the present invention showing the first and second struts locked relative to one another;

FIG. 6 is a view taken along the lines 6—6 of FIG. 2.

DESCRIPTION OF THE PREFERRED EMBODIMENTS

Figure 3:
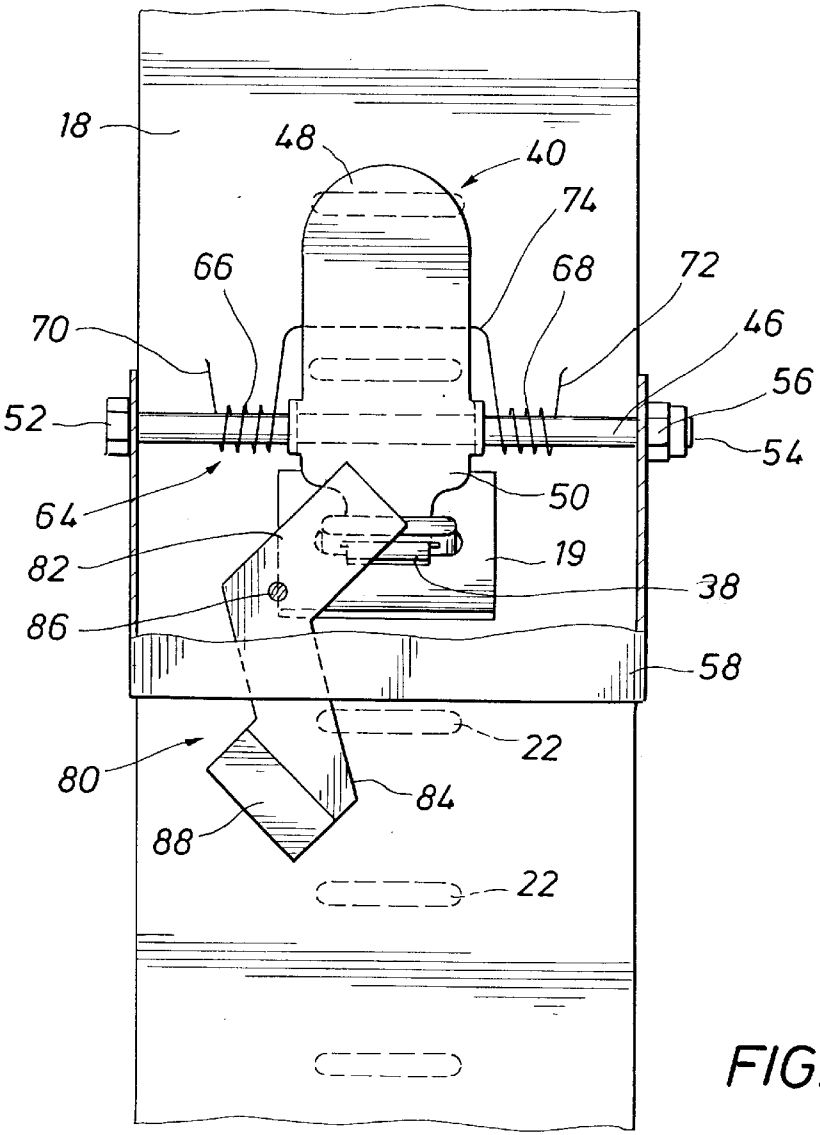
FIG. 3 is an enlarged, front elevational view with portions broken away to show the safety latch of the present invention in a first position.

While the adjustable leg will be described with particular reference to an adjustable leg used with stilts, work benches, and the like, it is to be understood that it is not so limited. The adjustable leg of the present invention can be used as a support leg in a wide variety of applications where it is desired to quickly and securely adjust the height of the leg and therefore the object and/or person supported by the leg.

With reference then to FIG. 1, an adjustable leg shown generally as 10 is seen to comprise a first, or upper, strut 12 and a second, or lower, strut 14, upper and lower having reference to the disposition of the adjustable leg 10 shown in FIG. 1. It will be understood that strut 12 extends upwardly and is connected to a bench or some other structure that it supports, or forms part of a stilt, such as disclosed in U.S. Pat. No. 4,569,516. Likewise, it will be understood that the lower strut 14 extends downwardly to a suitable footpad or the like to engage the floor or other suitable surface, e.g., a stair step. The first strut 12 has an end wall 16 defining an outer surface 18 having a reinforcing plate 19 attached, as by welding, thereto while the second, or lower, strut 14 has an end wall 20, end wall 20 being provided with a plurality of longitudinally spaced apertures 22, only two of which are shown in FIG. 1. It will also be seen that end wall 20 of strut 14 is positioned generally adjacent end wall 16 of strut 12. As best seen with reference to FIG. 6, first strut 12 is generally channel-shaped and has first and second spaced side walls 24 and 26 that are attached to end wall 16 and extend in a direction away from outer surface 18 and terminate in the formation of first and second lips 28 and 30, attached to first and second end walls 24 and 26, respectively, lips 28 and 30 extending towards one another and being aligned generally parallel with first strut end wall 16. Likewise, second strut 14 is generally channel-shaped and, as can be seen in FIG. 6, is complementary in shape but slightly smaller than first strut 12 such that second strut 14 snugly but slidably, e.g., telescopically, fits into first strut 12. Indeed, it can be seen that lips 28, 30, side walls 24, 26, and end wall 16 prevent any substantial lateral movement of strut 14 relative to strut 12 while permitting sliding or telescopic movement of strut 14 relative to strut 12. It will be appreciated that while first and second struts 12 and 14 are shown as being generally channel-shaped when viewed in transverse cross-section, it will be appreciated that other shapes could be employed, i.e., struts 12 and 14 could be tubular with various shaped cross-sections. Indeed, struts 12 and 14 can be of any cross-sectional configuration, the only requisite being that at least one of the struts be slidable with respect to the other strut, and further that one of the struts have an aperture and the other of the struts have a series of spaced apertures, or at least indentations, such that a suitable locking member or dog, when placed through the aperture of the first strut, passes through or engages in the aperture or indentation of the second strut, can prevent relative sliding or longitudinal movement of the two struts. It is also necessary, as will be appreciated by those skilled in the art, that the two struts be shaped so that lateral, as opposed to longitudinal, movement between the struts is substantially precluded.

Figure 2:
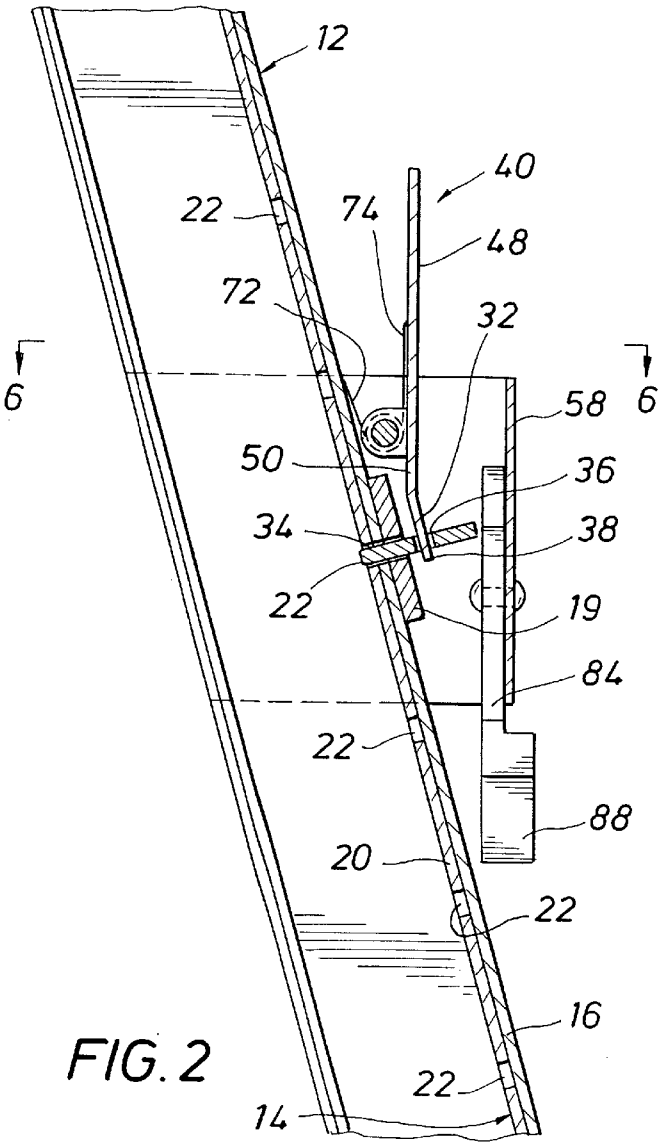
FIG. 2 is a side elevational view, partly in section, showing the locking or latching mechanism used to prevent relative longitudinal movement of the first and second struts.

With reference now to FIG. 2, struts 12 and 14 are shown in the locked position such that strut 14 is unable to slide or move telescopically relative to strut 12. As can also be seen from FIG. 2, an aperture 32 extends through end wall 16 and reinforcing plate 19 and is in register with one of the apertures 22 in strut 14. As noted above, apertures 22 can be in the form of indentations or recesses that do not extend through second strut end wall 20. Projecting into apertures 32 and 22 is a latching dog 34, latching dog 34 being provided with a slot 36 (see FIG. 5) in which is received the tongue 38 of a lever, shown generally as 40. As best seen with reference to FIG. 6, lever 40 is provided with spaced pillow blocks 42 and 44, each of which define a circular bearing opening. A shaft 46 is journalled through the bearing openings in pillow blocks 42 and 44 and serves to define an axis of rotation for lever 40. Lever 40 is thereby divided into a first portion 48 on one side of the axis of rotation defined by shaft 46 and a second portion 50 on the other side of the axis of rotation defined by shaft 46, portion 50 partially defining tongue 38.

Figure 4:
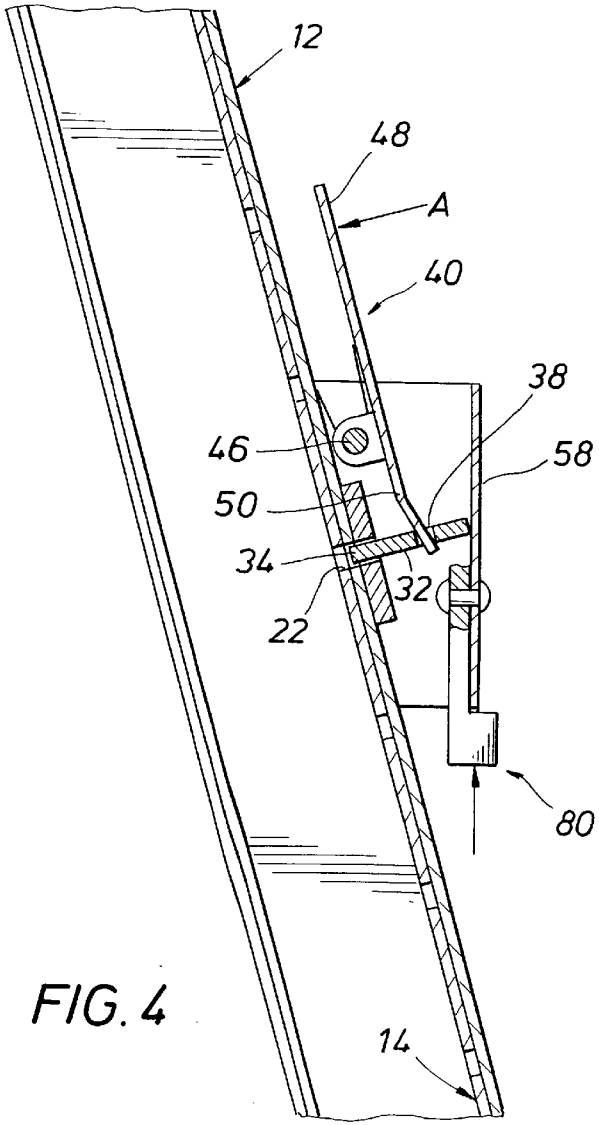
FIG. 4 is a side elevational view, partly in section, similar to FIG. 2 but showing the locking mechanism of the present invention being released so as to permit relative telescopic movement of the first and second struts.

Shaft 46 is actually a bolt having a head 52, a threaded end 54, and a threaded nut 56. To mount shaft 46, there is provided a generally U-shaped bracket having a web 58 interconnecting first and second legs 60 and 62. Legs 60 and 62 are secured, e.g., as by welding, to first and second spaced side walls 24 and 26. Legs 60 and 62 are provided with registering circular openings through which shaft 46 extends. It will thus be seen that with nut 56 received on threaded end 54 of shaft 46, shaft 46 is securely mounted via the U bracket to first strut 12. As best seen in FIG. 3, disposed on shaft 46 is a coil spring, shown generally as 64, coil spring 64 comprising a first coil section 66; a spaced, second coil section 68; a first end finger 70; and a second end finger 72. Coil sections 66 and 68 are interconnected by a loop section 74. As best seen with reference to FIG. 2, coil spring 64 is disposed on shaft 46 such that loop 74 resiliently engages the first portion 48 of lever 40 while the fingers 70, 72 engage the outer surface 18 of end wall 16. Accordingly, coil spring 64 serves to urge first portion 48 of lever 40 away from first strut 12, i.e., first portion 48 of lever 40 is resiliently biased outwardly away from outer surface 18. Conversely, second portion 50 of lever 40 is biased inwardly toward outer surface 18. As best seen with reference to FIG. 2, the net result is that the tongue 38 of second portion 50 of tongue 40 urges dog 34 into registering apertures 32, 22, it being recalled that tongue 38 is received in the slot 36 in dog 34. It should also be observed that slot 36 and tongue 38 are dimensioned so that dog 34 essentially floats in lever 40. In particular, since dog 34 and lever 40 are in essentially a "floating relationship" with one another, there is little chance of dog 34 binding, although it is to be recognized that dog 34 could be rigidly attached to lever 40, the only prerequisite being that dog 34 extend through aperture 32 and one of the apertures 22 when the latter apertures are in register. In the position shown in FIG. 2, with slots 32 and 22 in register and with dog 34 received therein, relative longitudinal, sliding, or telescopic movement between struts 12 and 14 is effectively prevented. Furthermore, because lever 40, in the manner described above, biases dog 34 into registering apertures 32 and 22, it requires the application of force to the first portion 48 of lever 40 to permit such telescopic movement. In this regard, reference is now made to FIG. 4 where the arrow A indicates an application of force against the first portion 48 of lever 40. As can be seen, as lever 40 is depressed, it rotates around the axis determined by shaft 46, forcing tongue 38 of second portion 50 of lever 40 to retract dog 34 out of aperture 22, which now permits strut 14 to slide relative to strut 12. As can be seen in FIG. 4, dog 34 is allowed limited motion away from outer surface 18 by virtue of web 58, which serves as a stop to the extent that while dog 34 is moved out of aperture 22, it is still received in aperture 32.

It will thus be seen from the above that to quickly adjust the height of adjustable leg 10, it is only necessary to apply force to lever 40 in the direction shown by arrow A in FIG. 4, whereupon strut 14 can be adjusted to a different height, i.e., until another of the apertures 22 is in register with aperture 32.

As can be seen from the figures, lever 40 is generally on the "outside" of adjustable leg 10. Accordingly, unlike the adjustable leg shown in U.S. Pat. No. 4,569,516, wherein the release latch or lock is to be accessed from the back or underside of the leg, lever 40 is much more convenient to activate.

To avoid the possibility that lever 40 will be accidentally actuated, i.e., dog 34 will be moved out of aperture 22, allowing strut 14 to move relative strut 12, the present invention provides, as an added feature, a safety latch. With reference first to FIG. 3, the safety latch, shown generally as 80, is an angled member having a first run 82 and a second run 84, latch 80 being pivotally mounted on web 58 by means of a pivot pin 86. As shown in FIGS. 2 and 3, the first run 82 of latch 80 is disposed between web 58 and dog 34. Accordingly, and as can be best seen with reference to FIGS. 2 and 3, even if lever 40 is pushed against the action of the coil spring 64 with latch 80 in the position shown in FIGS. 2 and 3, dog 34 cannot move out of recess 22, and accordingly, strut 14 cannot slide or move relative to strut 12.

The second run 84 of lever 80 is provided with a weighted end 88 that, provided that the adjustable leg 10 is in a generally upright or vertical position, will maintain lever 80 in the position shown in FIG. 3, i.e., with first run 82 disposed between web 58 and dog 34 to prevent dog 34 from being retracted sufficiently out of aperture 22 to permit telescopic movement of strut 14 relative to strut 12. In effect, safety latch 80 is gravity-biased into the fail-safe position such that even if lever 48 is pushed in the direction shown in arrow A of FIG. 4, dog 34 cannot be released.

Figure 5:
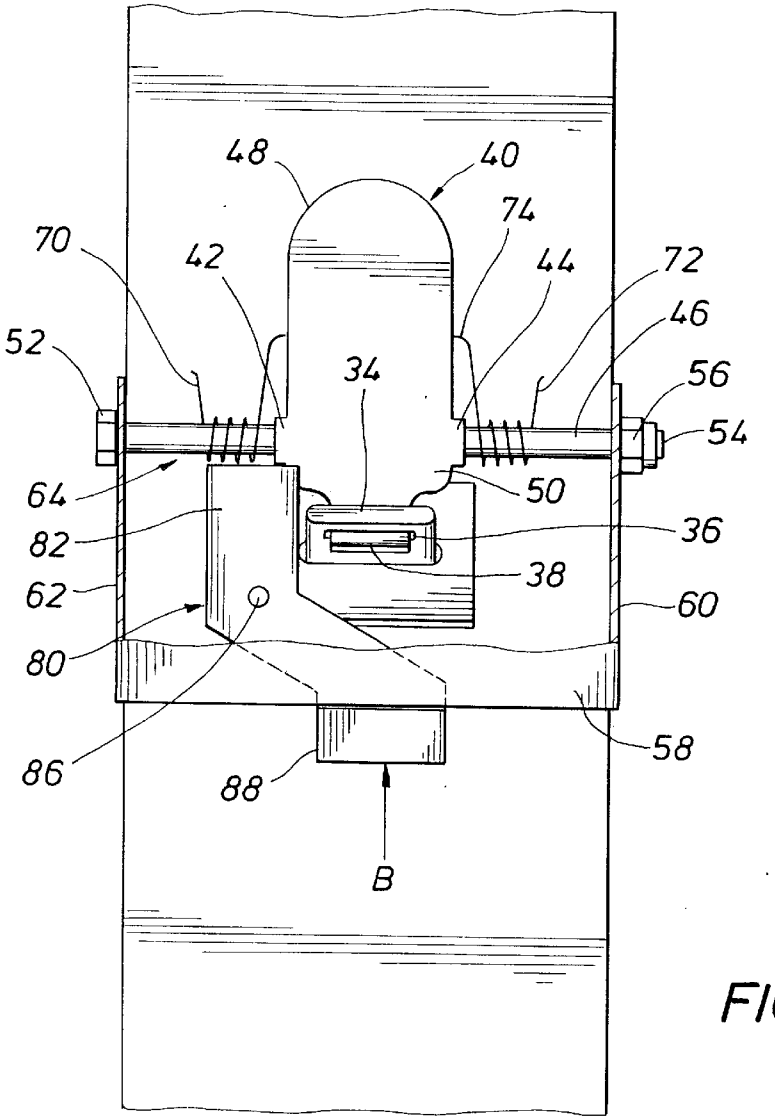
FIG. 5 is a view similar to FIG. 3 but showing the safety latch in a second, released position so that the strut locking mechanism can be released.

With reference to FIG. 5, it will be seen that if an upward pressure indicated by arrow B is applied to weighted portion 88 of lever 80, lever 80 will pivot around pivot point 86 to the position shown in FIG. 5. At this time, lever 40 can then be actuated by applying pressure, as shown by arrow A in FIG. 4, to allow dog 34 to move toward web 58 sufficiently to permit dog 34 to move out of aperture 22 and permit strut 14 to move relative to strut 12. In essence, it will be seen that with the use of the safety latch, two manual, but yet quick, steps are required to adjust leg 10; i.e., first safety latch 80 must be manually moved, and then lever 40 must be depressed against the force of the spring 64. It will be appreciated that while, as viewed in FIGS. 3 and 5, leg 10 will also generally be in a substantially vertical position, if for some reason leg 10 is at an angle to the vertical, safety latch 80 need only be provided with additional weighting sufficient to accommodate any such off-vertical angle.

It will also be appreciated that the safety latch of the present invention can take many other forms, i.e., it need not be gravity-weighted. Instead, it is only necessary that the safety latch of the present invention have a member that can be selectively positioned between dog 34 and web 58 to prevent any motion of dog 34 away from outer surface 18 sufficient to permit telescopic or sliding movement of strut 14 relative to strut 12.

While the resilient biaser has been described with reference to a spring and, more specifically, a coil spring, it is apparent, first of all, that other types of springs, such as sear springs, flat springs, compression springs, flat spiral springs, disc springs, plate springs, etc., could also be used. Furthermore, such resilient biasers could take the form of a resilient member, such as a rubber bellows, or some other rubber formation. Lastly, the biaser could be disposed between the second portion of the lever and the first strut end wall, in which event the biaser would actually resiliently pull, e.g., by means of a tension spring, the second portion towards the first strut end wall.

The foregoing description and examples illustrate selected embodiments of the present invention. In light thereof, variations and modifications will be suggested to one skilled in the art, all of which are in the spirit and purview of this invention.

What is claimed is:

1. An adjustable leg, comprising:

a first elongate strut, said first elongate strut having a first strut end wall defining an outer surface, said first strut end wall having a first aperture therein;

a second elongate strut, said second elongate strut having a second strut end wall and being telescopically received in said first strut, said first strut end wall being adjacent said second strut end wall, said second strut end wall having a plurality of second apertures therein;

a lever journalled for rotational movement about an axis outward of said outer surface on said first strut end wall, said lever having a first portion on one side of said axis of rotation and a second portion on the other side of said axis of rotation, said lever including at least one bearing member defining a circular bearing surface;

a shaft journalled in said bearing surface, said shaft being mounted on said first strut outwardly of said outer surface;

a coil spring, said spring having at least one spring extension engaging said first strut end wall and a second spring extension engaging said first portion of said lever, said first and second spring extensions acting to urge said first strut end wall and said first portion of said lever away from one another;

a latching dog carried by said second portion of said lever and being in register with said first aperture, said spring urging said latching dog into said first aperture whereby when said first aperture is in register with one of said second apertures, said dog extends through said first and second apertures to thereby prevent any substantial telescopic movement between said first and second struts.

2. The adjustable leg of claim 1 wherein said bearing members include spaced first and second pillow blocks formed on said lever, said shaft having a first end distal said first pillow block and a second end distal said second pillow block, said coil spring comprising a first coil section and a second coil section, said first and second coil sections having first and second end fingers, said coil spring further comprising an intermediate loop section connecting said first and second coil sections, said first coil section being received on said shaft between said first end of said shaft and said first pillow block, said second coil section being received on said shaft between said second end of said shaft and said second pillow block, said first and second fingers resiliently engaging said first strut end wall, said loop section resiliently engaging said first portion of said lever whereby said first portion of said lever is urged away from said first strut end wall.

3. The adjustable leg of claim 1, further including a generally U-shaped bracket having first and second legs and a connecting web, said first strut further including first and second, spaced side walls depending from said first strut end wall in a direction away from said outer surface, said first and second legs of said bracket being secured to said first and second side walls, respectively, of said first strut, said first and second ends of said shaft being journalled through first and second openings in said first and second legs of said bracket, respectively.

4. The adjustable leg of claim 3 wherein said web overlies said first aperture and serves as a stop to limit movement of said dog away from said outer surface of said first strut.

5. The adjustable leg of claim 4, further including a safety latch to prevent removal of said dog from said first and second apertures, said safety latch being pivotally secured to said web and having a first run that is disposed between said dog and said web when said safety latch is in a first position and a second run, said second run being engageable by the finger of a user to move said first run out of said first position and into a second position wherein said first run is not disposed between said web and said dog.

6. The adjustable leg of claim 5 wherein said safety latch is gravity-biased to said first position.

7. An adjustable leg, comprising:

a first elongate strut, said first elongate strut having a first strut end wall defining an outer surface, said first strut end wall having a first aperture therein;

a second elongate strut, said second elongate strut having a second strut end wall and being telescopically received in said first strut, said first strut end wall being adjacent said second strut end wall, said second strut end wall having a plurality of second apertures therein;

a lever journalled for rotational movement about an axis outward of said outer surface on said first strut end wall, said lever having a first portion on one side of said axis of rotation and a second portion on the other side of axis of rotation;

a resilient biaser to urge said first portion of said lever away from said first strut end wall;

a latching dog carried by said second portion of said lever and being in register with said first aperture, said dog including a slot and said second portion of said lever including a tongue portion, said tongue portion of said lever being received in said slot, said slot and said tongue portion being sized so as to permit said dog floating movement relative to said lever, said resilient biaser urging said latching dog into said first aperture whereby when said first aperture is in register with one of said second apertures, said dog extends through said first and second apertures to thereby prevent any substantial telescopic movement between said first and second struts.

8. An adjustable leg, comprising:

a first elongate strut, said first elongate strut having a first strut end wall defining an outer surface, said first strut end wall having a first aperture therein;

a second elongate strut, said second elongate strut having a second strut end wall and being telescopically received in said first strut, said first strut end wall being adjacent said second strut end wall, said second strut end wall having a plurality of second apertures therein;

a lever journalled for rotational movement about an axis outward of said outer surface on said first strut end wall, said lever having a first portion on one side of said axis of rotation and a second portion on the other side of said axis of rotation;

a resilient biaser to urge said first portion of said lever away from said first strut end wall;

a latching dog carried by said second portion of said lever and being in register with said first aperture, said resilient biaser urging said latching dog into said first aperture whereby when said first aperture is in register with one of said second apertures, said dog extends through said first and second apertures to thereby prevent any substantial telescopic movement between said first and second struts; and a safety latch having a first position and a second position, said safety latch serving, when in said first position, to prevent any motion of said dog away from said outer surface sufficient to permit telescopic movement between said first and second struts, said safety latch being gravity biased in said first position.

9. An adjustable leg, comprising:

a first elongate strut, said first elongate strut having a first strut end wall defining an outer surface, said first strut end wall having a first aperture therein, said first strut being generally channel-shaped, having first and second space side walls attached to and depending from said first strut end wall in a direction away from said outer surface, said first strut further including first and second lips, said first and second lips extending towards one another and extending from said first and second side walls, respectively, distal said first strut end wall;

a second elongate strut, said second elongate strut having a second strut end wall and being telescopically received in said first strut, said first strut end wall being adjacent said second strut end wall, said second strut end wall having a plurality of second apertures therein;

a lever journalled for rotational movement about an axis outward of said outer surface on said first strut end wall, said lever having a first portion on one side of said axis of rotation and a second portion on the other side of said axis of rotation;

a resilient biaser to urge said first portion of said lever away from said first strut end wall; and a latching dog carried by said second portion of said lever and being in register with first aperture, said resilient biaser urging said latching dog into said first aperture whereby when said first aperture is in register with one of said second apertures, said dog extends through said first and second apertures to thereby prevent any substantial telescopic movement between said first and second struts.

10. The adjustable leg of claim 9 wherein said second strut comprises a member defining an outer profile complementary in shape to said first strut, said second strut being snugly, slidably received in said first strut whereby said first and second struts are precluded from any substantial relative lateral movement.

11. The adjustable leg of claim 10 wherein said second strut is generally channel-shaped.

* * * * *